US005769034A

United States Patent [19]

Zilka et al.

[11] Patent Number: 5,769,034

[45] Date of Patent: Jun. 23, 1998

[54] DEVICE, SYSTEM AND METHOD FOR ON-LINE EXPLOSIVE DESLAGGING

[76] Inventors: Frank Zilka, 318 Fitch Rd.; Tim Zilka, 200 Lake Ave., both of Saratoga, N.Y. 12866; Kurt Prouty, 47 Bay Path La., Norwell, Mass. 02061; Don Howard, 147 Juniper Dr., Ballston Spa, N.Y. 02020

[21] Appl. No.: 786,096

[22] Filed: Jan. 17, 1997

[51] Int. Cl.[6] ..... F22B 37/18; F22B 37/48; F28G 1/00

[52] U.S. Cl. ..... 122/379; 165/84; 165/95

[58] Field of Search ..... 122/379; 165/84, 165/95

[56] References Cited

U.S. PATENT DOCUMENTS

| | | | |
|---|---|---|---|
| 3,552,259 | 1/1971 | Griffith | 86/20 |
| 4,166,418 | 9/1979 | Calder, Jr. | 102/24 R |
| 4,167,139 | 9/1979 | Gleason et al. | 102/24 R |
| 4,354,294 | 10/1982 | Silver . | |
| 4,462,319 | 7/1984 | Larsen . | |
| 4,545,411 | 10/1985 | Wierzba . | |
| 4,639,381 | 1/1987 | Wierzba . | |
| 5,056,587 | 10/1991 | Jones . | |
| 5,113,802 | 5/1992 | LeBlanc | 122/379 |
| 5,193,491 | 3/1993 | Oslin . | |
| 5,196,648 | 3/1993 | Jones . | |
| 5,211,135 | 5/1993 | Correia . | |
| 5,279,676 | 1/1994 | Oslin . | |
| 5,307,743 | 5/1994 | Jones . | |
| 5,494,004 | 2/1996 | Hunter . | |
| 5,517,950 | 5/1996 | Kendrick . | |

*Primary Examiner*—Teresa J. Walberg
*Assistant Examiner*—Jiping Lu
*Attorney, Agent, or Firm*—Jay R. Yablon

[57] ABSTRACT

A device, system and method permitting on-line explosives-based cleaning and deslagging of a fuel burning facility such as a boiler, furnace, incinerator, or scrubber. A coolant, such as ordinary water, is delivered to the explosives to prevent them from detonating due to the heat of the on-line facility. Thus, controlled, appropriately-timed detonation can be initiated as desired, and boiler scale and slag is removed without the need to shut down or cool down the facility.

22 Claims, 4 Drawing Sheets

DEVICE, SYSTEM AND METHOD FOR ON-LINE EXPLOSIVE DESLAGGING

FIELD OF THE INVENTION

This disclosure relates generally to the field of boiler/furnace deslagging, and particularly, discloses a device, system and method allowing on-line, explosives-based deslagging.

BACKGROUND OF THE INVENTION

A variety of devices and methods are used to clean slag and similar deposits from boilers, furnaces, and similar heat exchange devices. Some of these rely on chemicals or fluids that interact with and erode deposits. Water cannons, steam cleaners, pressurized air, and similar approaches are also used. Some approaches also make use of temperature variations. And, of course, various types of explosive, creating strong shock waves to blast slag deposits off of the boiler, are also very commonly used for deslagging.

The use of explosive devices for deslagging is a particularly effective method, as the large shock wave from an explosion, appropriately positioned and timed, can easily and quickly separate large quantities of slag from the boiler surfaces. But the process is costly, since the boiler must be shut down (i.e. brought off line) in order to perform this type of cleaning, and valuable production time is thereby lost. This lost time is not only the time during which the cleaning process is being performed. Also lost are several hours prior to cleaning when the boiler must be taken off line to cool down, and several hours subsequent to cleaning for the boiler to be restarted and brought into full operational capacity.

Were the boiler to remain on-line during cleaning, the immense heat of the boiler would prematurely detonate any explosive placed into the boiler, before the explosive has been properly positioned for detonation, rendering the process ineffective and possibly damaging the boiler. Worse, loss of control over the precise timing of detonation would create a serious danger for personnel located near the boiler at the time of detonation. So, to date, it has been necessary to shut down any heat exchange device for which explosives-based deslagging is desired.

Several U.S. patents have been issued on various uses of explosives for deslagging. U.S. Pat. Nos. 5,307,743 and 5,196,648 disclose, respectively, an apparatus and method for deslagging wherein the explosive is placed into a series of hollow, flexible tubes, and detonated in a timed sequence. The geometric configuration of the explosive placement, and the timing, are chosen to optimize the deslagging process.

U.S. Pat. No. 5,211,135 discloses a plurality of loop clusters of detonating cord placed about boiler tubing panels. These are again geometrically positioned, and detonated with certain timed delays, to optimize effectiveness.

U.S. Pat. No. 5,056,587 similarly discloses placement of explosive cord about the tubing panels at preselected, appropriately spaced locations, and detonation at preselected intervals, once again, to optimize the vibratory pattern of the tubing for slag separation.

Each of these patents discloses certain geometric configurations for placement of the explosive, as well as timed, sequential detonation, so as to enhance the deslagging process. But in all of these disclosures, the essential problem remains. If the boiler were to remain on-line during deslagging, the heat of the boiler would cause the explosive to prematurely detonate before it is properly placed, and this uncontrolled explosion will not be effective, may damage the boiler, and could cause serious injury to personnel.

It would be desirable if a device, system and method could be devised which would allow explosives to safely and controllably be used for deslagging, on-line, without any need to shut down the boiler during the deslagging process. By enabling a boiler or similar heat-exchange device to remain on-line for explosives-based deslagging, valuable operations time for fuel-burning facilities could then be recovered.

OBJECTS OF THE INVENTION

It is therefore an object of this invention to provide a device, system and method whereby explosives may be used to clean a boiler, furnace, scrubber, or any other heat exchange device, fuel burning, or incinerating device, without requiring that device to be shut down, thereby enabling that device to remain in full operation during deslagging.

It is a further object of this invention to enable valuable operations time to be recovered, by virtue of eliminating the need for shutdown of the device or facility to be cleaned.

It is a further object of this invention to enhance personnel safety and facility integrity, by enabling this on-line explosives-based cleaning to occur in a safe and controlled manner.

SUMMARY OF THE INVENTION

This invention enables explosives to be used for cleaning slag from a hot, on-line boiler, furnace, or similar fuel-burning or incineration device, by delivering a coolant to the explosive which maintains the temperature of the explosive well below what is required for detonation. The explosive, while it is being cooled, is delivered to its desired position inside the hot boiler without detonation. It is then detonated in a controlled manner, at the time desired.

While many obvious variations may occur to someone of ordinary skill in the relevant arts, the preferred embodiment disclosed herein uses a perforated or semi-permeable membrane which envelopes the explosive and the cap or similar device used to detonate the explosive. A liquid coolant, such as ordinary water, is delivered at a fairly constant flow rate into the interior of the envelope, thereby cooling the external surface of the explosive and maintaining the explosive well below detonation temperature. Coolant within the membrane in turn flows out of the membrane at a fairly constant rate, through perforations or microscopic apertures in the membrane. Thus cooler coolant constantly flows into the membrane while hotter coolant that has been heated by the boiler flows out of the membrane, and the explosive is maintained at a temperature well below that needed for detonation. Coolant flow rates typical of the preferred embodiment run between 20 and 80 gallons per minute.

This coolant flow is initiated as the explosive is first being placed into the hot boiler. Once the explosive has been moved into the proper position and its temperature maintained at a low level, the explosive is detonated as desired, thereby separating the slag from, and thus cleaning, the boiler.

BRIEF DESCRIPTION OF THE DRAWING

The features of the invention believed to be novel are set forth in the appended claims. The invention, however, together with further objects and advantages thereof, may best be understood by reference to the following description taken in conjunction with the accompanying drawing(s) in which:

DETAILED DESCRIPTION OF THE PREFERRED EMBODIMENT OF THE INVENTION

Figure 1:
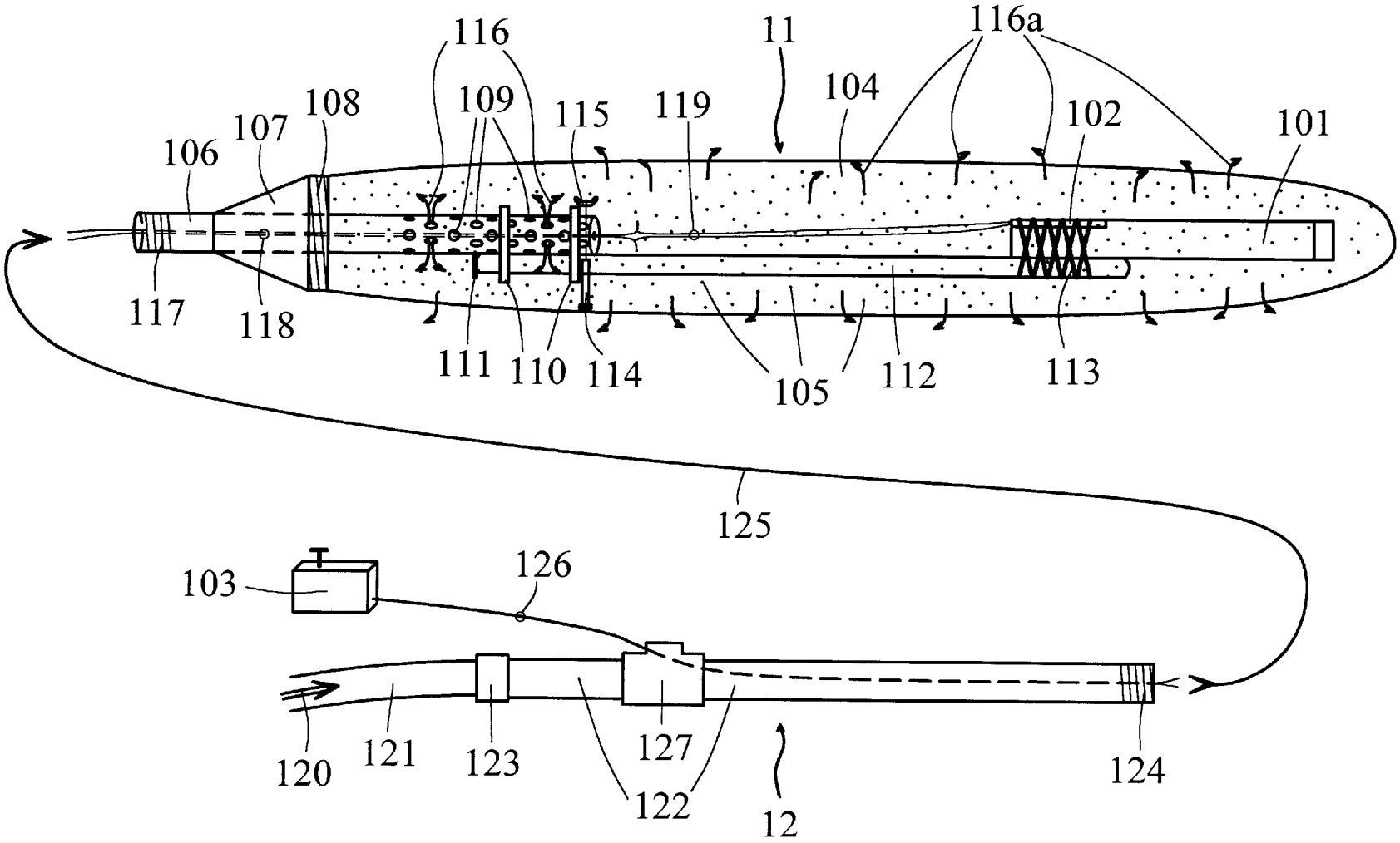
FIG. 1 depicts the preferred embodiment of a device, system and method used to perform on-line cleaning of a fuel-burning facility.

FIG. 1 depicts the basic tool used for on-line cleaning of a fuel-burning facility such as a boiler, furnace, or similar heat exchange device, or an incineration device, and the discussion following outlines the associated method for such on-line cleaning.

The cleaning of the fuel burning and/or incineration facility is carried out in the usual manner by means of an explosive device 101, such as but not limited to an explosive stick or other explosive device or configuration, placed appropriately inside the facility, and then detonated such that the shock waves from the explosion will cause slag and similar deposits to dislodge from the walls, tubing, etc. of the facility. This explosive device 101 is detonated by a standard explosive cap 102 or similar detonating device, which causes controlled detonation at the desired instant, based on a signal sent from a standard initiator 103, by a qualified operator.

However, to enable explosives-based cleaning to be performed on-line, i.e., with any need to power down or cool down the facility, two prior art problems must be overcome. First, since explosives are heat-sensitive, the placement of an explosive into a hot furnace can cause premature, uncontrolled detonation, creating danger to both the facility and personnel around the explosion. Hence, it is necessary to find a way of cooling the explosive while it is being placed in the on-line facility and readied for detonation. Second, it is not possible for a person to physically enter the furnace or boiler to place the explosive, due the immense heat of the on-line facility. Hence, it is necessary to devise a means of placing the explosive that can be managed and controlled from outside the burner or furnace.

In order to properly cool the explosive, a cooling envelope 104 is provided which completely envelopes the explosive. During operation, this envelope will have pumped into it a coolant, such as ordinary water, that will maintain the explosive device 101 in a cooled-down state until it is ready for detonation. Because of the direct contact between the coolant and the explosive device 101, this device is ideally made of a plastic or similar waterproof housing that contains the actual explosive powder or other explosive material.

This cooling envelope 104 is a semi-permeable membrane that allows water to flow out of it at a fairly controlled rate. It can have a series of small perforations punched into it, or can be constructed of any semi-permeable membrane material appropriate to its coolant-delivery function as will outlined herein. This semi-permeability characteristic is illustrated by the series of small dots 105 scattered throughout the envelope 104 as depicted in FIG. 1.

At an open end (coolant entry opening), the envelope 104 is attached to a coolant delivery pipe 106 via an envelope connector 107. As depicted here, the envelope connector 107 is cone-shaped apparatus permanently affixed to the coolant delivery pipe 106, and it further comprises a standard threading 108. The envelope itself, at this open end, is fitted and permanently affixed to complementary threading (not shown) that is easily screwed into and fitted with the threading 108 of the connector 107. While FIG. 1 depicts screw threads in connection with a cone-shaped apparatus as the particular means of attaching the envelope 104 to the coolant delivery pipe 106, any type of clamp, and indeed, many other means of attachment know to someone of ordinary skill would also be provide a feasible and obvious alternative, and such substitutions for attaching the envelope 104 to the pipe 106 are fully contemplated to be within the scope of this disclosure and its associated claims.

The coolant delivery pipe 106, in the region where said pipe resides within the envelope 104, further contains a number of coolant delivery apertures 109, twin ring holders 110, and an optional butt plate 111. The explosive device 101 with cap 102 is affixed to one end of an explosive connector (broomstick) 112 with explosive-to-broomstick attachment means 113 such as duct tape, wire, rope, or any other means that provides a secure attachment. The other end of the broomstick is slid through the twin ring holders 110 until it abuts the butt plate 111, as shown. At that point, the broomstick, optionally, may be further secured by means of, for example, a bolt 114 and wingnut 115 running through both the broomstick 112 and the pipe 106 as depicted. While the rings 110, butt plate 111, and nut and bolt 115 and 114 provide one way to secure the broomstick 112 to the pipe 106, many other ways to secure the broomstick 112 to the pipe 106 can also be devised by someone of ordinary skill, all of which are contemplated within the scope of this disclosure and its related claims. The length of the broomstick 112 may vary, though for optimum effectiveness, it should maintain the explosive 101 at approximately two or more feet from the end of the pipe 106 that contains the coolant delivery apertures 109, which, since it is desirable to reuse the pipe 106 and its components, will minimize any possible damage to the pipe 106 and said components when the explosive is detonated, and will also reduce any shock waves sent back down the pipe to the operator of this invention.

With the configuration disclosed thus far, a coolant such as water under pressure entering the left side of the pipe 106 as depicted in FIG. 1 will travel through the pipe and exit the pipe through the coolant delivery apertures 109 in a manner illustrated by the directional flow arrows 116. Upon exiting the pipe 106 through the apertures 109, the coolant then enters the inside of the envelope 104 and begins to fill up and expand the envelope. As the coolant fills the envelope, it will come into contact with and cool the explosive device 101. Because the envelope 104 is semi-permeable (105), water will also exit the envelope as the envelope becomes full as shown by the directional arrows 116*a*, and so the entry under pressure of new water into the pipe 106 combined with the exit of water through the semipermeable (105) envelope 104, will deliver a continuous and stable flow of coolant to the explosive device 101.

The entire cooling and cleaning delivery assembly 11 disclosed thus far, is in turn connected to a coolant supply and explosive positioning system 12 as follows. A hose 121 with water service (for example, but not limited to, a standard ¾" Chicago firehose and water service) is attached to a hydraulic tube 122 (e.g. pipe) using any suitable hose attachment fitting 123. The coolant, preferable ordinary water, runs under pressure through the hose as indicated by the directional flow arrow 120. The end of the tube 122 opposite the hose 121 contains attachment means 124 such as screw threading, which complements and joins with similar threading 117 on the pipe 106. Of course, any means known to someone of ordinary skill for joining the tube 122 and pipe 106 in the manner suggested by the arrow 125 in FIG. 1, such that coolant can run from the hose 121 through the tube 122, into the pipe 106, and finally into the envelope 104, is acceptable and contemplated by this disclosure and its associated claims.

Finally, detonation is achieved by electrically connecting the explosive cap 102 to the initiator 103. This is achieved by connecting the initiator 103 to a lead wire pair 126, in turn connecting to a second lead wire pair 118, in turn connecting to a cap wire pair 119. This cap wire pair 119 is finally connected to the cap 102. The lead wire pair 126 enters the tube 122 from the initiator 103 through a lead wire entry port 127 as shown, and then runs through the inside of the tube 122, and out the far end of the tube. (This entry port 127 can be constructed in any manner obvious to someone of ordinary skill, so long as it enables the wire 126 to enter the tube 122 and averts any significant coolant leakage.) The second lead wire pair 118 runs through the inside of the pipe 106, and the cap wire pair 119 is enclosed within the envelope 104 as shown. Thus, when the initiator 103 is activated by the operator, an electrical current flows straight to the cap 102, detonating the explosive 101.

While FIG. 1 thus depicts electronic detonation of the cap and explosive via a hard wire signal connection, it is contemplated that any alternative means of detonation known to someone of ordinary skill could also be employed, and is encompassed by this disclosure and its associated claims. Thus, for example, detonation by a remote control signal connection between the initiator and cap (which will be further discussed in FIG. 4), eliminating the need for the wires 126, 118, and 119, is very much an alternative preferred embodiment for detonation. Similarly, non-electronic shock (i.e. percussion), and heatsensitive detonation can also be used within the spirit and scope of this disclosure and its associated claims.

While any suitable liquid can be pumped into this system as a coolant, the preferred coolant is ordinary water. This is less expensive than any other coolant, it performs the necessary cooling properly, and it is readily available at any site which has a pressurized water supply that may be delivered into this system. Notwithstanding this preference for ordinary water as the coolant, this disclosure contemplates that many other coolants known to someone of ordinary skill can also be used for this purpose as well, and all such coolants are regarded to be within the scope of the claims.

Figure 2:
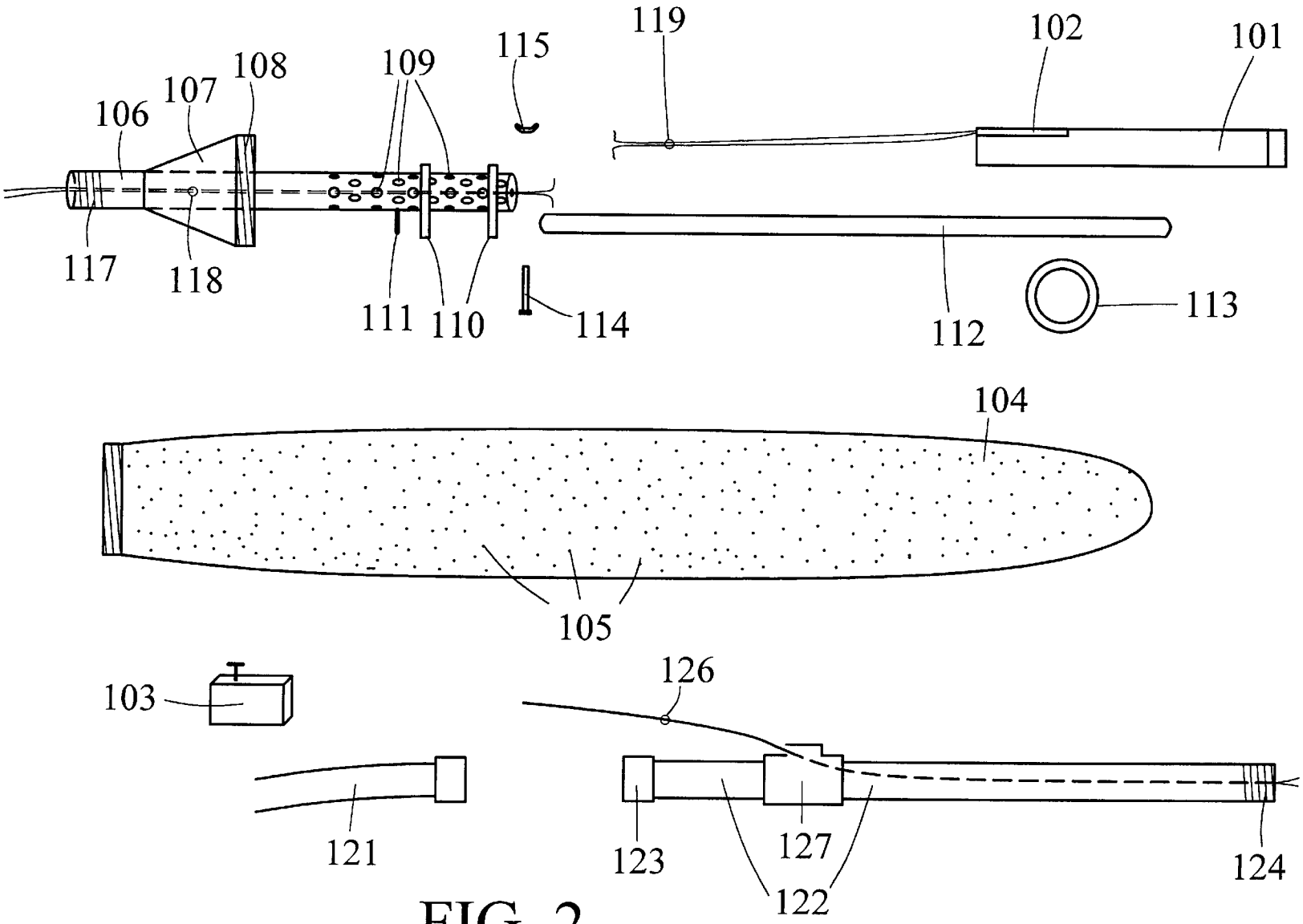
FIG. 2 depicts the device in its disassembled (preassembly) state, and is used to illustrate the method by which this device is assembled for use.

At this point, we turn to discuss methods by which the on-line cleaning device disclosed above is assembled for use and then used. FIG. 2 shows the preferred embodiment of FIG. 1 in preassembly state, disassembled into its primary components. The explosive 101 is attached to the cap 102, with the cap in turn connected to the one end of the cap wire pair 119. This assembly is attached to one end of the broomstick 112 using the explosive-to-broomstick attachment means 113 such as duct tape, wire, rope, etc., or any other approach known to someone of ordinary skill, as earlier depicted in FIG. 1. The other end of the broomstick 112 is slid into the twin ring holders 110 of the pipe 106 until it abuts the butt plate 111, also as earlier shown in FIG. 1. The bolt 114 and nut 115, or any other obvious means, may be used to further secure the broomstick 112 to the pipe 106. The second lead wire pair 118 is attached to the remaining end of the cap wire pair 119 to provide an electrical connection therebetween. Once this assemblage has been achieved, the semipermeable (105) cooling envelope 104 is slid over the entire assembly, and attached to the envelope connector 107 using the threading 108, clamp, or any other obvious attachment means, as depicted in FIG. 1.

The right-hand side (in FIG. 2) of lead wire pair 126 is attached to the remaining end of the second lead wire pair 118 providing an electrical connection therebetween. The pipe 106 is then attached to one end of the hydraulic tube 122 as also discussed in connection with FIG. 1, and the hose 121 is hooked to the other end of the tube 122, completing all coolant delivery connections. The initiator 103 is attached to the remaining end of the lead wire pair 126 forming an electrical connection therebetween, and completing the electrical connection from the initiator 103 to the cap 102.

When all of the above connections have been achieved, the on-line cleaning device is fully assembled into the configuration shown in FIG. 1.

Figure 3:
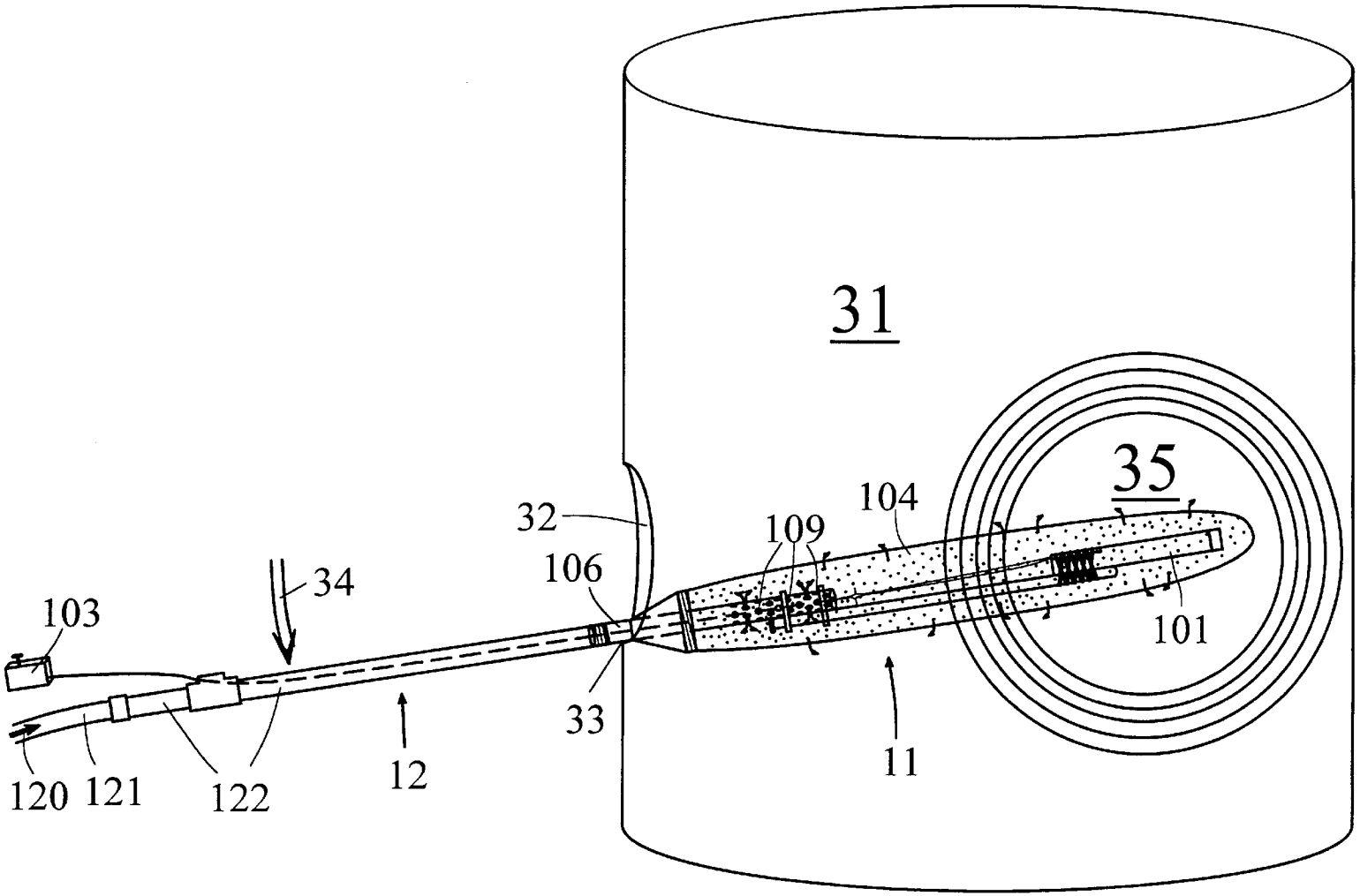
FIG. 3 illustrates the use of the assembled cleaning device to clean an on-line fuel burning or incineration facility.

FIG. 3 now depicts the usage of this fully assembled on-line cleaning device, to clean a fuel burning facility 31 such as a boiler, furnace, scrubber, incinerator, etc., and indeed any fuel-burning or refuse-burning device for which cleaning by explosives is suitable. Once the cleaning device has been assembled as discussed in connection with FIG. 2, the flow 120 of coolant through the hose 121 is commenced. As the coolant passes through the hydraulic tube 122 and pipe 106, it will emerge from the coolant apertures 109 to fill the envelope 104 and provide a flow of coolant (e.g. water) to surround the explosive 101, maintaining the explosive at a relatively cool temperature. Optimal flow rates range between approximately 20 and 80 gallons per minute.

Once this flow is established and the explosive is maintained in a cool state, the entire cooling and cleaning delivery assembly 11 is placed into the on-line facility 31 through an entry port 32 such as a manway, handway, portal, or other similar means of entry, while the coolant supply and explosive positioning system 12 remains outside of said facility. At a location near where assembly 11 meets system 12, the pipe 106 or tube 122 is rested against the bottom of the entry port 32 at the point designated by 33. Because the coolant pumped through the envelope 104 introduces a fair amount of weight into assembly 11 (with some weight also added to the system 12), a downward force designated by 34 is exerted to the system 12, with the point 33 acting as the fulcrum. Applying appropriate force 34 and using 33 as the fulcrum, the operator positions the explosive 101 to the position desired. It is further possible to place a fulcrum fitting device (not shown) at location 33, so as to provide a stable fulcrum and also protect the bottom of the port 32 from the significant weight pressure that will be exerted at the fulcrum. Throughout this time, new (cooler) coolant is constantly flowing into the system while older (hotter) coolant which has been heated by the on-line facility exits via the semipermeable envelope 104, so that this continued flow of coolant into the system maintains the explosive 101 in a cool state. Finally, when the operator has moved the explosive 101 in the desired position, the initiator 103 is activated to initiate the explosion. This explosion creates a shock wave in region 35, which thereby cleans and deslags that region of the boiler or similar facility, while the boiler/facility is still hot and on-line.

Referring back to FIG. 2, during the explosion, the explosive 101, cap 102, cap wire 119, broomstick 112, and broomstick attachment means 113 are all destroyed by the explosion, as is the envelope 104. Thus, it is preferable to fabricate the broomstick 112 out of wood or some other material that is extremely inexpensive and disposable after a single use. Similarly, the envelope 104, which is for a single use only, should be fabricated from a material that is inexpensive, yet durable enough to maintain physical integrity while water is being pumped into it under pressure. And of course, this envelope 104 must be semi-permeable (105), which can be achieved, for example, by using any appropriate membrane which in essence acts as a filter, either with a limited number of macroscopic puncture holes, or a large number of fine, microscopic holes.

On the other hand, all other components, particularly the pipe 106 and all of its components 107, 108, 109, 110, 111, and 118, as well as the bolt 114 and nut 115, are reusable, and so should be designed from materials that provide proper durability in the vicinity of the explosion. (Again, note that the length of the broomstick 112 determines the distance of the pipe 106 and its said components from the explosion, and that approximately two feet or more is a desirable distance to impose between the explosive 101 and any said component of the pipe 106.)

Additionally, because coolant filling the envelope 104 adds significant weight to the right of the fulcrum 33 in FIG. 3, the materials used to construct the cleaning delivery assembly 11 should be as lightweight as possible so long as they can endure both the heat of the furnace and the explosion (the envelope 104 should be as light as possible yet resistant to any possible heat damage), while to counterbalance the weight of 11, the coolant supply and explosive positioning system 12 may be constructed of heavier materials, and may optionally in added weight simple for ballast. Water weight can also be counterbalanced by lengthening the system 12 so that force 34 can be applied farther from the fulcrum 33. And of course, although the system 12 is shown here as embodying a single tube 122, it is obvious that this assembly can also be designed to employ a plurality of tubes attached to one another, and can also be designed so as to telescope from a shorter tube into a longer tube. All such variations, and others that may be obvious to someone of ordinary skill, are fully contemplated by this disclosure and included within the scope of its associated claims.

Figure 4:
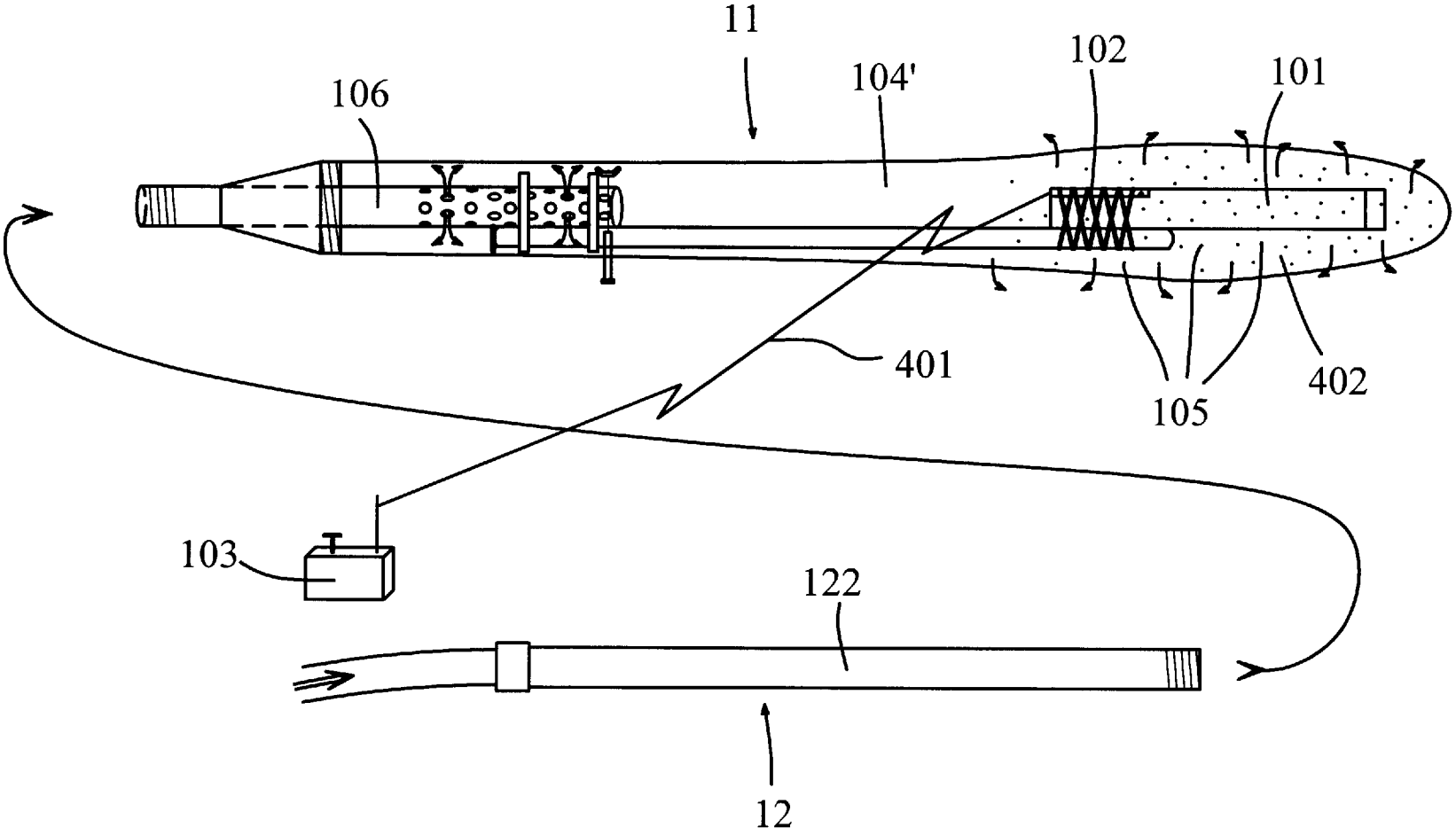
FIG. 4 depicts an alternative preferred embodiment of this invention, which reduces coolant weight and enhances control over coolant flow, and which utilizes remote detonation.

FIG. 4 depicts an alternative preferred embodiment of this invention with reduced coolant weight and enhanced control over coolant flow, and remote detonation.

In this alternative embodiment, the cap 102 now detonates the explosive 101 by a remote control wireless signal 401 connection sent from the initiator 103 to the cap 102. This eliminates the need for the lead wire entry port 127 that was shown in FIG. 1 on the tube 122, as well as the need to run the wire pairs 126, 118 and 119 through the system to carry current from the initiator 103 to the cap 102.

FIG. 4 further shows a modified envelope 104', which is narrower where the coolant first enters from the pipe 106 and wider in the region 402 of the explosive 101. Additionally, this envelope is impermeable in the region where coolant first enters the pipe, and permeable (105) only in the region near the explosive 101. This modification achieves two results.

First, since a main object of this invention is to cool the explosive 101 so that it can be introduced into an on-line fuelburning facility, it is desirable to make the region of the envelope 104' where the explosive is not present as narrow as possible, thus reducing the water weight in this region and making it easier to achieve a proper weight balance about the fulcrum, as discussed in connection with FIG. 3. Similarly, by broadening the envelope 104' near the explosive 101, as shown by 402, a greater volume of coolant will reside in precisely the area that it is needed to cool the explosive 101, thus enhancing cooling efficiency.

Second, since it desirable for hotter coolant that has been in the envelope for a period of time to leave the system in favor of cooler coolant being newly introduced into the envelope, the impermeability of the entry region and mid-section of the envelope 104' will enable all newly-introduced coolant to reach the explosive before that coolant is allowed to exit the envelope 104' from its permeable (105) section 402. Similarly, the coolant in the permeable region of the envelope will typically have been in the envelope longest, and will therefore be the hottest. Hence, the hotter coolant leaving the system is precisely the coolant that should be leaving, while the cooler coolant cannot exit the system until it has travelled through the entire system and thus become hotter and therefore ready to leave.

While the disclosure thus far has discussed the preferred embodiment, it will be obvious to someone of ordinary skill that there are many alternative embodiments for achieving the result of the disclosed invention. For example, although a liner, stick configuration and a single explosive device was discussed here, any other geometric configuration of explosives, including a plurality of explosive devices, and/or including the introduction of various delay timing features as among such a plurality of explosive devices, is also contemplated within the scope of this disclosure and its associated claims. This would include, for example, the various explosive configurations such as those disclosed in the various U.S. Patents earlier-cited herein, wherein these explosive configurations are provided a similar means by which a coolant can be delivered to the explosive in such a way as to permit on-line detonation. In short, it is contemplated that the delivery of coolant to one or more explosive devices by any means obvious to someone of ordinary skill, enabling those explosive devices to be introduced into an on-line fuel-burning facility and then simultaneously or serially detonated in a controlled manner, is contemplated by this disclosure and covered within the scope of its associated claims.

Further, while only certain preferred features of the invention have been illustrated and described, many modifications, changes and substitutions will occur to those skilled in the art. It is, therefore, to be understood that the appended claims are intended to cover all such modifications and changes as fall within the true spirit of the invention.

We claim:

1. An explosives-based system for deslagging a hot, online heat-exchange device, comprising:

an explosive device;

a cooling envelope enveloping said explosive device;

coolant-delivery means delivering a flow of coolant into said cooling envelope such that said explosive device is thereby surrounded and cooled by said coolant;

explosive positioning means enabling at least one person holding and moving a first of two ends of said explosive positioning means, to move the cooled explosive affixed proximate a second of said two ends of said explosive positioning means into and within said hot, online heat exchange device into a proper position for deslagqing the heat exchange device by detonation of said explosive device, while said coolant is so-delivered into the envelope and thereby prevents the heat of said heat exchange device from detonating said explosive, and while said at least one person remains outside said hot, online heat exchange device; and detonating means for detonating said explosive device at will.

2. The system of claim 1, wherein said coolant-delivery means and said explosive positioning means coincide such that said coolant is so-delivered to said cooling envelope through said explosive positioning means.

3. The system of claim 1, wherein said cooling envelope is semipermeable; whereby coolant entering the envelope through a coolant entry opening of the envelope exits the envelope through the permeations in the envelope, resulting in a steady flow of coolant to and past said explosive device.

4. The system of claim 3, wherein said cooling envelope is semipermeable in the region surrounding the explosive and impermeable in the region proximate said coolant entry opening; whereby relatively hotter coolant which has been in the envelope for a relatively longer time exits the envelope before relatively cooler coolant which has been in the envelope for a relatively shorter time, resulting in more effective cooling of the explosive.

5. The system of claim 1, wherein said cooling envelope is wider in the region surrounding the explosive and narrower in all other regions; whereby the explosive is properly cooled while the weight of coolant within the envelope is maintained as low as possible, therefore making it easier to properly position the explosive for deslagging detonation.

6. The system of claim 1, wherein said coolant-delivery means comprises a coolant delivery pipe coincident with said second end, and is connected at said second end to and within said cooling envelope such that a section of said coolant delivery pipe resides outside said cooling envelope and a remaining section of said pipe resides within said cooling envelope, and wherein the coolant flow into the envelope is realized by said coolant entering the section of the pipe residing outside the envelope, flowing through the pipe to said remaining section within the envelope, and then exiting said remaining section into the envelope.

7. The system of claim 1, further comprising explosive connector means connecting said explosive device in a position within said cooling envelope, wherein said coolant-delivery means further comprises a coolant delivery pipe coincident with its second end, wherein said explosive connector means is affixed to the explosive and the pipe so as to maintain the explosive and the pipe in position relative to one another, and hence the explosive in said position within said cooling envelope.

8. The system of claim 1, further comprising explosive connector means connecting said explosive device in a position within said cooling envelope.

9. The system of claim 1, further comprising a cap affixed to the explosive, and an initiator, wherein activation of said initiator activates said cap, and the activation of said cap in turn detonates the explosive.

10. The system of claim 9, wherein the cap is so-activated by the initiator via a remote control, wireless signal.

11. The system of claim 1, said coolant-delivery means comprising a hydraulic tube attached to a separate coolant delivery pipe, wherein each of said explosive device, said cooling envelope, said coolant delivery pipe, explosive connector means connecting said explosive device in a position within said cooling envelope, and said hydraulic tube is a separate module of said system prior to the assembly of these modules into said system, and wherein subsequent to said assembly, the resulting configuration is such that:

a cap is affixed to the explosive;

a signal connection is established between an initiator and said cap;

the pipe and the explosive are affixed in position relative to one another, via said explosive connector means;

the envelope is affixed to a first of two ends of the pipe such that it envelopes the explosive; and the hydraulic tube is affixed to a second of said two ends of the pipe.

12. A method for deslagging a hot, online heat-exchange device, comprising the steps of:

delivering a flow of coolant into a cooling envelope enveloping an explosive device, via coolant-delivery means, such that said explosive device is thereby surrounded and cooled by said coolant;

holding and moving a first of two ends of an explosive positioning means, and thereby moving the cooled explosive affixed proximate a second of said two ends of said explosive positioning means into and within said hot, online heat exchange device into a proper position for deslagging the heat exchange device by detonation of said explosive device, while so-delivering said coolant into the envelope and thereby preventing the heat of said heat exchange device from detonating said explosive, and while remaining outside said hot, online heat exchange device; and detonating said explosive device at will, once said cooled explosive has been moved into said proper position for deslagging detonation.

13. The method of claim 12, wherein the step of delivering a flow of coolant into said cooling envelope comprises delivering said coolant to said cooling envelope through said explosive positioning means.

14. The method of claim 12, wherein said cooling envelope is semipermeable, and wherein the step of delivering the coolant flow thereby further comprises enabling said coolant to enter the envelope through a coolant entry opening of the envelope and exit the envelope through the permeations in said envelope, resulting in a steady flow of coolant to and past said explosive device.

15. The method of claim 14, wherein said cooling envelope is semipermeable in the region surrounding the explosive and impermeable in the region proximate said coolant entry opening; whereby relatively hotter coolant which has been in the envelope for a relatively longer time will exit the envelope before relatively cooler coolant which has been in the envelope for a relatively shorter time, thereby enhancing the step of delivering the coolant flow.

16. The method of claim 12, wherein said cooling envelope is wider in the region surrounding the explosive and narrower in all other regions; whereby the explosive is properly cooled while the weight of coolant within the envelope is maintained as low as possible, thereby making easier the step of holding and moving said coolant-delivery means in a manner that enables proper positioning of the explosive for deslagging.

17. The method of claim 12, wherein said coolant-delivery means further comprises a coolant delivery pipe coincident with its second end, and is connected at said second end to and within said cooling envelope, and wherein the step of delivering the coolant flow into the envelope further comprises said coolant entering said coolant delivery pipe from a section of the pipe residing outside the envelope, flowing through the pipe to a remaining section within said cooling envelope, and then exiting said remaining section into the envelope.

18. The method of claim 12, wherein said explosive device is connected via explosive connector means in a position within said cooling envelope.

19. The method of claim 12, wherein a cap is affixed to the explosive, and wherein the step of detonating said explosive device at will comprises the steps of activating an initiator, said initiator in turn activating said cap, and said cap in turn detonating the explosive.

20. The method of claim 19, wherein the step of said initiator activating said cap comprises sending a remote control, wireless signal from said initiator to said cap.

21. A method for assembling an explosives-based system for deslagging a hot, online heat-exchange device, comprising the steps of:

affixing a cap to an explosive device;

establishing a signal connection between an initiator and said cap;

affixing a coolant delivery pipe and said explosive in predetermined position relative to one another, via an explosive connector;

affixing a cooling envelope to a first end of two ends of the pipe such that it envelopes the explosive; and affixing a hydraulic tube to a second end of said two ends of the pipe.

22. An explosives-based system for deslagging a hot, online heat-exchange device, comprising:

an explosive device, a cooling envelope, a coolant delivery pipe, an explosive connector means, and a hydraulic tube, each of which is a separate module of said system prior to assembly of these modules into said system, wherein subsequent to said assembly, the resulting configuration is such that:

a cap is affixed to the explosive;

a signal connection is established between an initiator and said cap;

the pipe and the explosive are affixed in predetermined position relative to one another, via said explosive connector means;

the envelope is affixed to a first of two ends of the pipe such that it envelopes the explosive; and the hydraulic tube is affixed to a second of said two ends of the pipe.

* * * * *